United States Patent [19]

Eichel

[11] Patent Number: 5,005,824

[45] Date of Patent: Apr. 9, 1991

[54] METHOD OF AVOIDING A CONTINUOUS CLENCH POSITION OF THE HAND AND FINGERS

[76] Inventor: Hermman J. Eichel, 2571 Clarion Ct., Columbus, Ohio 43220

[21] Appl. No.: 541,337

[22] Filed: Jun. 21, 1990

[51] Int. Cl.[5] ..... A61H 1/02; A61F 13/44; A63B 5/00

[52] U.S. Cl. ..... 272/67; 128/165; 128/26

[58] Field of Search ..... 128/26, 67, 848, 861, 128/878-890, 165, 44; 273/54 R, 54 B; 272/67, 68, 119; 600/26, 27

[56] References Cited

U.S. PATENT DOCUMENTS

| | | | |
|---|---|---|---|
| D. 259,955 | 7/1981 | Helferich | 273/54 B X |
| 505,745 | 9/1893 | Barclay . | |
| 2,077,202 | 4/1937 | Barrie | 273/54 B X |
| 2,553,277 | 5/1951 | Robinson et al. . | |
| 2,693,794 | 11/1954 | Neville | 128/878 X |
| 2,738,190 | 3/1956 | Tureaud | 273/54 B |
| 2,924,458 | 2/1960 | Barry | 273/54 B |
| 3,327,703 | 6/1967 | Gamm | 273/54 B X |
| 3,327,705 | 6/1967 | Miller et al. | 128/165 |
| 3,421,160 | 1/1969 | Domenico | 273/54 B X |
| 3,421,500 | 1/1969 | Jacobson . | |
| 3,496,573 | 2/1970 | Kuchas et al. . | |
| 3,547,112 | 12/1970 | Courtney . | |
| 3,640,532 | 2/1972 | Bauer . | |
| 3,736,926 | 6/1973 | Irby | 128/879 |
| 4,105,200 | 8/1978 | Unter . | |
| 4,220,334 | 9/1980 | Kanamoto et al. . | |
| 4,247,097 | 1/1981 | Schwartz | 272/119 |
| 4,441,711 | 4/1984 | Dubar et al. | 273/54 B |
| 4,575,075 | 3/1986 | Tarbox et al. | 272/119 |
| 4,665,900 | 5/1987 | Saringer | 128/26 |
| 4,711,445 | 12/1987 | Whitehead | 272/67 |
| 4,907,574 | 3/1990 | Hollerbach | 128/44 X |

*Primary Examiner*—Richard J. Apley
*Assistant Examiner*—Linda C. M. Dvorak
*Attorney, Agent, or Firm*—Jacox & Meckstroth

[57] ABSTRACT

A device for attachment to a person's hand which is afflicted with arthritis or the like. The device is adapted for use as the person sleeps. The principal part of the device is a body of resilient spongy material which is positioned upon and attached to the palm portion of the hand of the person, adjacent the root portions of the person's fingers. During a period of sleep, when the person's fingers bend toward a fist or clenched condition, the fingers compress the body of resilient spongy material, and energy is stored within the body of resilient spongy material. Thus, during sleep, when the muscles of the fingers relax, the energy within the body of resileint spongy material forces the fingers toward an open position. Thus, there is periodic flexing of the afflicted fingers, and the degree of stiffness and pain in the afflicted fingers is controlled or reduced while the person sleeps.

6 Claims, 1 Drawing Sheet

4
5
A
B
10
14
16
16a
16b
17
18
19
20
20,22
22
40
44
48
48,50
50
60
70

METHOD OF AVOIDING A CONTINUOUS CLENCH POSITION OF THE HAND AND FINGERS

RELATED APPLICATION

This application is a continuation of Application Ser. No. 07/309,777, filed Feb. 7, 1989, now abandoned.

BACKGROUND OF THE INVENTION

In the management of arthritis, especially rheumatoid arthritis, and particularly in the early stages of the disease, it is quite common to note a loss of mobility and pain in an afflicted joint after a period of inaction, for example, after a period of sleep. Physicians recognize the fact that joint and muscle symptoms in regard to such physical problems are most severe after the patient has been physically inactive. These symptoms lessen in varying degrees after physical activity is resumed.

Thus, in diseases of this type, and in physical problems resulting from minor injuries, etc., it is beneficial to provide a method of periodic flexing or manipulation of the afflicted joint and muscle in a manner which is gentle and convenient but which will reduce the onset or degree of stiffness and pain associated with a period of inactivity, such as during a period of sleep.

The following U.S. Pat. Nos. are known: 2,553,277, 3,421,500, 3,547,112, 3,496,573, 3,640,532, 4,105,200, and 4,220,334. However, all of the devices shown in these patents are employed by a person who is fully conscious and alert and who is controlling or attempting to control movement of his/her body parts during use of the devices shown.

It is therefore an object of this invention to provide a device which provides passive reflexive manipulation to joints and muscles which are afflicted by arthritis or other such physical problems or the like.

It is another object of this invention to provide such a device which functions without the use of external energy sources.

It is another object of this invention to provide such a device which is capable of functioning when the patient is unaware that the device is functioning, for example, during periods in which the patient is asleep.

It is another object of this invention to provide a means and a method which provide passive reflexive manipulation to joints and muscles during periods of inactivity, such as during periods of sleep.

It is another object of this invention to provide such a device which includes means for maintaining the device in proper position upon the hand of the person who uses the device.

Other objects and advantages of this invention reside in the construction of parts, the combination thereof, and the methods involved, as will become more apparent from the following description.

SUMMARY OF THE INVENTION

The device of this invention is adapted to be employed during periods of sleep. During a period of sleep the fingers of a person's hand tend to bend to a clenched condition. This invention includes a body of resilient spongy material. The body of resilient spongy material is attached to the palm portion of a hand which is afflicted with arthritis or the like. The body of resilient spongy material is positioned adjacent the root portion of the fingers of the afflicted hand.

As stated above, while a person is asleep the person's fingers tend to bend and clench. As this bending movement of the fingers occurs, the body of resilient spongy material is engaged and is compressed. Thus, the body of resilient spongy material is deformed from its normal shape, and energy is stored within the body of resilient spongy material. As the person sleeps and as the muscles which perform the bending movement of the afflicted fingers relax, the energy in the body of resilient spongy material causes the body of resilient spongy material to expand and to assume its normal shape. In such expansion of the body of resilient spongy material, the body of resilient spongy material forces reverse or return movement of the afflicted fingers, and the body of resilient spongy material returns the afflicted fingers to or toward their open positions. Each repetition of this passive reflex cycle, while the person sleeps, serves to reduce the potentially debilitating and painful conditions associated with immobilization of the joint and muscle of the afflicted fingers.

This cycle of flexing may occur frequently while the person is asleep, and while the person is unaware that this cycling and flexing is occurring.

Thus, the device and method of this invention reduce or eliminate the onset or degree of stiffness and pain associated with inactivity in afflicted fingers of a person's hand.

DETAILED DESCRIPTION OF THE PREFERRED EMBODIMENT

Figures 1, 2, 3, 4, 5, 6, 7:
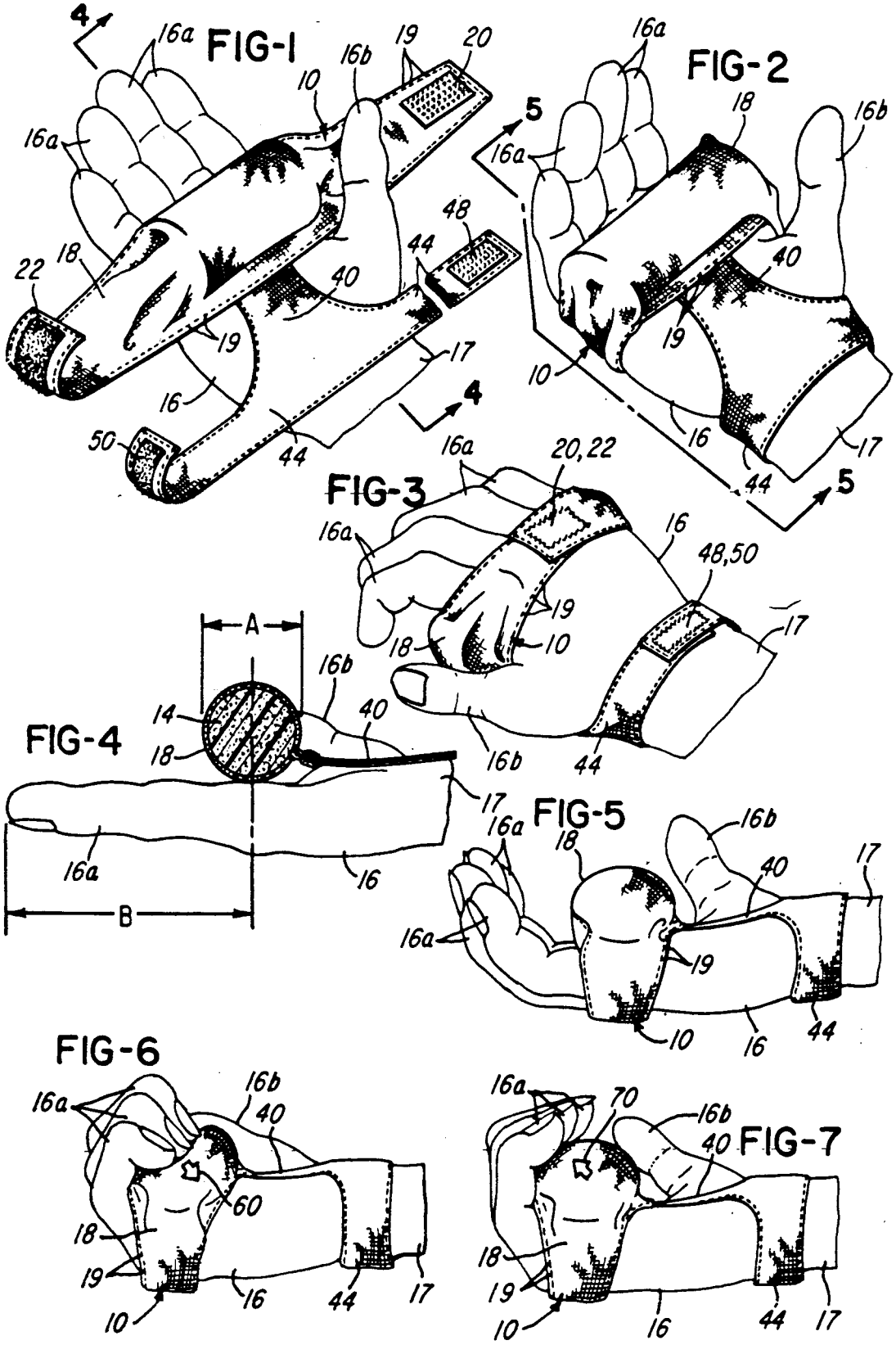
FIG. 1 is a perspective view, illustrating an initial step in positioning and attaching a device of this invention to the hand of a person who is afflicted by arthritis or the like in the fingers of the hand. This figure shows the palm portion of the hand.
FIG. 2 is a perspective view illustrating a subsequent step in attaching a device of this invention to the hand. This view also shows the palm portion of the hand.
FIG. 3 is a perspective view showing the back surface of the hand and showing the device of this invention attached to the hand.
FIG. 4 is a sectional view taken substantially on line 4—4 of FIG. 1. This figure illustrates the preferred ratio between the transverse dimension of the body of resilient spongy material positioned upon the hand and the length of the longest finger of the hand.
FIG. 5 is a side elevational view taken substantially on line 5—5 of FIG. 2.
FIG. 6 is a side elevational view illustrating bending movement of the fingers of the hand and showing compression of the body of resilient spongy material of the device of this invention.
FIG. 7 is a side elevational view illustrating reverse bending movement of the fingers, as the reverse bending movement is forced by operation of the body of resilient spongy material of the device of this invention.

As shown in the drawings, a passive stimulation device of this invention comprises a flexible support band 10. Supported by the support band 10 is a body or roll 14 of resilient spongy material. The roll 14 has a length which is substantially equal to the width of a person's hand 16. The drawings also show a wrist 17 from which the hand 16 extends. Preferably, the transverse dimension of the roll 14 is circular and between one inch and two inches in diameter, depending upon the size of the person's hand 16 to which the roll 14 is applied. Also, as illustrated in FIG. 4, preferably, the transverse dimension of the roll 14, or the diameter of the roll 14, is approximately one-half the length of the longest finger 16*a* of the person's hand.

The roll 14 is covered by a sheet 18 of covering material. The sheet 18 is attached to the support band 10 by means of stitches 19 so that the sheet 18 secures the roll 14 to the support band 10. Also carried by the support band 10 is a patch 20 of hook and pile attachment material and a patch 22 of hook and pile attachment material. The support band 10 is wrapped around the hand 16, and the patches 20 and 22 are attached together, thus securing the support band 10 to the hand 16. It is to be understood, however, that any other suitable means for attaching the support band 10 to the hand 16 may be employed.

The support band 10 and the roll 14 are positioned in the knuckle region of the person's hand 16, with the roll 14 on the palm side of the hand and adjacent the roots of the fingers 16*a*, and between the roots of the fingers 16*a* and thumb 16*b*. Preferably, the support band 10 has a substantial width so that the band 10 engages the thumb 16*b*, as shown in FIGS. 1 and 3. Thus, the band 10 retains the roll 14 in desired position adjacent the roots of the fingers 16*a* of the hand 16.

Attached to the support band 10 and extending laterally therefrom is a connector 40. The connector 40 is also attached to a wrist band 44. Attached to the wrist band 44 is a patch 48 of hook and pile material and a patch 50 of hook and pile material. As the support band 10 is attached to the hand 16, the wrist band is attached to the wrist 17 by means of the hook and pile patches 48 and 50 or by any other suitable means. The wrist band 44 assists in maintaining the roll 14 in desired position adjacent the roots of the fingers 16*a*. The band 10, as it is in engagement with the thumb 16*b*, prevents the roll 14 from moving toward the thumb 16*b*. The wrist band 44 prevents the roll 14 from moving toward the distal portions of the fingers 16*a*.

Thus, the device of this invention is attached to a person's hand 16 and wrist 17, as best illustrated in FIGS. 2, 3, and 5, and the roll 14 is maintained in the desired position thereof.

The device is so attached to a person's hand 16 prior to a period of inaction of the person, such as prior to a period of sleeping.

When a person sleeps, the fingers 16*a* of the hand 16 unconsciously tend to bend, as illustrated by an arrow 60 in FIG. 6. When this occurs, the fingers 16*a* bend and engage the roll 14 and force at least partial compression of the roll 14. The roll 14 is of a resilient spongy material, such as polyurethane foam or the like. The resilient spongy material is preferably one which is depressed about one-fourth of its transverse dimension by application of a force of approximately 1.2 kilograms per square centimeter. Thus, energy is transferred into the roll 14 by bending movement of the fingers 16*a* and by pressure of the fingers 16*a* upon the roll 14. Therefore, when the muscles of the fingers 16*a* relax, the energy stored in the resilient roll 14 forces the fingers 16*a* toward a straightened position, as illustrated by an arrow 70 in FIG. 7.

Thus, while the person sleeps the fingers 16*a* are flexed as illustrated.

As stated above and as illustrated in the figures of the drawing, particularly as illustrated in FIG. 4, the transverse dimension "A" or diameter of the body 14 of resilient spongy material is approximately one-half or slightly less than one-half the length "B" of the longest finger 16*a* of the afflicted hand 16. This ratio ensures that contact of the fingers 16*a* of the hand 16 with the body 14 will occur during the most propitious segment of bending movement of the fingers 16*a* from the open position, illustrated in FIG. 4, to a clenched position, illustrated in FIG. 6.

It is during this intermediate or propitious segment of the bending movement of the fingers 16*a*, as shown in FIG. 6, that the fingers 16*a* are able to exert the greatest pressure, that is, to transmit the greatest magnitude of force upon the body 14 of resilient spongy material. At the onset of the bending movement of the fingers 16*a* the leverage of the fingers 16*a* is at a mechanical disadvantage. Therefore, at the initial bending position premature contact with a body of resilient spongy material can be sufficient to impede or completely prevent clenching movement, thus effectively immobilizing the fingers 16*a*.

This impeding action would occur if the body 14 of resilient spongy material were significantly greater in transverse dimension than one-half the length of the longest finger 16*a* of the hand 16.

Such impeding action is in opposition to the desired effect of allowing the fingers 16*a* to approach a fully clenched position following engagement of the fingers 16*a* with the body of resilient spongy material. The fingers 16*a* should approach a fully clenched position when the fingers engage the body 14 of resilient spongy material. Therefore, upon initiation of muscle relaxation in the hand 16 the body 14 of resilient spongy material returns the fingers 16*a* toward open position, as resilient action occurs in the body 14 of resilient spongy material. The resilient action occurs as a result of the energy stored within the body 14 of resilient spongy material as clenching of the fingers 16*a* upon the body 14 of resilient spongy material occurs.

It is this virtually complete cycle of clenching, relaxation and return toward the open hand position that enables the gentle manipulation of the afflicted fingers to occur. The device and method of this invention enable this cycle to occur during a period of sleep. If the body 14 of resilient spongy material is too large or too small in transverse dimensions this passive-reactive manipulation-stimulation in the afflicted fingers does not occur.

This passive-reflective manipulation stimulation is not a voluntary action such as that which occurs with exercise devices which are willfully and consciously activated by a person.

This continued periodic flexing or manipulation of the fingers 16*a* during a period of sleep reduces the onset or degree of stiffness and pain associated with periods of sleep. Thus, a device and method of this invention are of significant value in reducing stiffness and pain in body members which are afflicted with arthritis or other such joint and muscle problems.

Although the preferred embodiment of the device and method of this invention have been described, it will be understood that within the purview of this invention various changes may be made in the form, details, proportion and arrangement of parts, the combination thereof, and the mode of use, which generally stated consist in a device and method to produce passive-reactive manipulation-stimulation in afflicted joints and muscles within the scope of the appended claims.

The invention having thus been described, the following is claimed.

1. A method of avoiding a continuous clench position of the hand and fingers of a person afflicted with a disease such as arthritis while the person is sleeping to reduce pain and discomfort in the hand and fingers after the person awakes, comprising the steps of forming a generally cylindrical resilient body of spongy material having an axial length approximately equal to the width of the person's hand and a cross-sectional diameter between one and two inches, positioning the resilient body within the palm of the person's hand with the body axis extending laterally across the hand and in a pressure position to be engaged by the tips of the fingers during unconscious flexing of the fingers toward a clenching condition, attaching the resilient body to the person's hand with a flexible material connected to the body and extending laterally around the person's hand, retaining the resilient body in the pressure position within the palm with a flexible material connected to the body and extending around the person's wrist to prevent the body from slipping off the person's fingers, and maintaining the resilient body in the pressure position while the person is sleeping.

2. A method of avoiding a continuous clench position of the hand and fingers of a person afflicted with a disease such as arthritis while the person is sleeping to reduce pain and discomfort in the hand and wrist after the person awakes, comprising the steps of forming a generally cylindrical resilient body of spongy material having an axial length approximately equal to the width of the person's hand and a cross-sectional diameter approximately equal to one-half the length of the middle finger on the person's hand, positioning the resilient body within the palm of the person's hand with the body axis extending laterally across the hand and in a pressure position to be engaged by the tips of the fingers during unconscious flexing of the fingers toward a clenching condition, attaching the resilient body to the person's hand with a flexible material connected to the body and extending laterally around the person's hand, retaining the resilient body in the pressure position within the palm with a flexible material connected to the body and extending around the person's wrist to prevent the body from slipping off the person's fingers, and maintaining the resilient body in the pressure position while the person is sleeping.

3. The method of claim 2 wherein the body is formed of a polyurethane foam material which can be depressed about one-fourth of its diameter by application of a force of approximately 1.2 kilograms per square centimeter.

4. The method of claim 2 wherein the attaching of the body to the hand is performed with a pair of flexible overlapping band portions extending around the person's hand, the retaining of the body is performed by a pair of flexible overlapping band portions extending around the person's wrist, and releasably connecting each pair of overlapping band portions with an adjustable fastener.

5. The method of claim 2 wherein the attaching of the body is provided by enclosing the body within a casing of fabric material, extending the fabric material to form a pair of flexible overlapping band portions around the person's hand, and releasably connecting the pair of overlapping band portions.

6. The method of claim 5 and wherein the retaining of the body is provided by a panel of fabric material connected to the casing and forming a pair of overlapping band portions extending around the person's wrist, and releasably connecting the pair of overlapping band portions.

* * * * *

UNITED STATES PATENT AND TRADEMARK OFFICE

CERTIFICATE OF CORRECTION

PATENT NO. : 5,005,824

DATED : April 9, 1991

INVENTOR(S) : Herman J. Eichel

It is certified that error appears in the above-identified patent and that said Letters Patent is hereby corrected as shown below:

Cover page, after "Inventor", change "Hermman" to ---Herman---.

Signed and Sealed this

Thirtieth Day of July, 1991

*Attest:*

*Attesting Officer*

HARRY F. MANBECK, JR.

*Commissioner of Patents and Trademarks*